US011480146B2

(12) United States Patent
Mathieu et al.

(10) Patent No.: US 11,480,146 B2
(45) Date of Patent: Oct. 25, 2022

(54) HEAT EXCHANGER APPARATUS

(71) Applicant: VOLVO TRUCK CORPORATION, Gothenburg (SE)

(72) Inventors: Gaël Mathieu, Lyons (FR); Olivier Mery De Montigny, Lyons (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/612,296

(22) PCT Filed: May 11, 2017

(86) PCT No.: PCT/IB2017/000675

§ 371 (c)(1),
(2) Date: Nov. 8, 2019

(87) PCT Pub. No.: WO2018/206991

PCT Pub. Date: Nov. 15, 2018

(65) Prior Publication Data

US 2020/0141376 A1 May 7, 2020

(51) Int. Cl.
*F02N 19/10* (2010.01)
*F01M 5/02* (2006.01)
(Continued)

(52) U.S. Cl.
CPC ..... *F02N 19/10* (2013.01); *F01M 5/021* (2013.01); *F02N 19/04* (2013.01); *F28D 9/0043* (2013.01);
(Continued)

(58) Field of Classification Search
CPC ..... F02N 19/10; F02N 19/04; F01M 5/021; F01M 5/002; F28D 9/0043;
(Continued)

(56) References Cited

U.S. PATENT DOCUMENTS 4,522,166 A * 6/1985 Toivio ..... F01M 5/021 123/196 AB
6,178,292 B1 * 1/2001 Fukuoka ..... F28F 9/002 165/181
(Continued)

FOREIGN PATENT DOCUMENTS

DE 2115221 A1 10/1972
DE 102005062338 A1 6/2007
(Continued)

OTHER PUBLICATIONS

International Search Report and Written Opinion dated Jan. 2, 2018 in corresponding International Application No. PCT/IB2017/000675, 9 pages.

*Primary Examiner* — Syed O Hasan
(74) *Attorney, Agent, or Firm* — Venable LLP; Jeffri A. Kaminski

(57) ABSTRACT

The present invention relates to a heat exchanger apparatus for a combustion engine. The apparatus comprises a heat exchanger comprising at least one magnetic component; and an induction heater positioned adjacent at least one magnetic component of the heat exchanger. The induction heater is connectable to a power supply to provide inductive heating to the heat exchanger.

8 Claims, 7 Drawing Sheets

(51) Int. Cl.

| | |
|---|---|
| ***F02N 19/04*** | (2010.01) |
| ***F28D 9/00*** | (2006.01) |
| ***F28F 21/08*** | (2006.01) |
| ***H05B 6/10*** | (2006.01) |
| *F28D 21/00* | (2006.01) |

(52) U.S. Cl.
CPC ..... *F28F 21/082* (2013.01); *H05B 6/108* (2013.01); *F28D 2021/0089* (2013.01)

(58) Field of Classification Search
CPC ..... F28D 2021/0089; F28D 9/005; F28F 21/082; F28F 21/02; F28F 21/065; H05B 6/108
See application file for complete search history.

(56) References Cited

U.S. PATENT DOCUMENTS

2001/0017121 A1* 8/2001 Mack ..... F01M 5/021 123/196 AB
2008/0156466 A1* 7/2008 Schmelz ..... F28D 7/06 165/41
2011/0062137 A1* 3/2011 Wu ..... F24H 1/009 219/202
2012/0255288 A1* 10/2012 Berger ..... F28D 9/0068 165/104.21

FOREIGN PATENT DOCUMENTS

DE 102007043047 A1 3/2009
DE 102009042581 * 9/2009
DE 102008060153 A1 6/2010
DE 102009042581 A1 * 3/2011 ..... B60H 1/2215
DE 102009042581 A1 3/2011
DE 102013013310 A1 2/2015
FR 3041422 A1 3/2017
GB 805715 A 12/1958

* cited by examiner

HEAT EXCHANGER APPARATUS

CROSS-REFERENCE TO RELATED APPLICATIONS

This application is a U.S. National Stage application of PCT/IB2017/000675, filed May 11, 2017 and published on Nov. 15, 2018 as WO2018/206991, all of which is hereby incorporated by reference in its entirety.

TECHNICAL FIELD

The invention relates to a heat exchanger apparatus, in particular to a heat exchanger apparatus for use in combustion engines. The present invention also relates to a vehicle comprising a heat exchanger apparatus, a method for manufacturing a heat exchanger apparatus, and a method of heating a heat exchange unit.

The invention can be applied in heavy-duty vehicles, such as trucks, buses and construction equipment. Although the invention will be described with respect to a motor vehicle and, as such, the invention is not restricted to any particular vehicle but may be particularly applicable to heavy-duty vehicles.

BACKGROUND

It can be difficult to start combustion engines of vehicles during winter months due to the low external temperatures. If an engine is started when the operating components of the engine are at a low temperature the engine produces an increased level of pollution during the first few miles. Fuel consumption is also high when the engine is operating at low temperatures. It has however been found that engines are easier to start, pollution is reduced or minimised, and fuel efficiency is improved if one or more of the operating members of the engine are warmed during the process of starting the engine.

There are a number of conventional devices for raising the temperature of components of a combustion engine. For example, engine heaters are used in regions with cold winters such as northern US, Canada, Russia and Scandinavia. Typically, an engine heater is immersed directly into either the engine coolant or the lubricant of a vehicle. There is however a risk of pressure loss within the system during the insertion of the engine heater into the engine fluids. Once inserted, the engine heater is connected to a normal AC power overnight or before driving via external power outlets. The heater element heats the fluid which is circulated by thermo-siphon through the engine. The use of an external power supply means that it is not possible to use the heater once the engine has been started. The heater can therefore not be used to speed up the rate at which the engine temperature increases once the engine has started. Furthermore, the dimensions, and therefore the exchange surfaces, of the engine heater are also limited by the need to be able to insert the heater directly into the engine fluids. As a result, the power than can be delivered from the engine heater to the fluid is also limited. There is also an associated risk of coolant boiling or oil cocking in regions adjacent to the engine heater.

Alternative devices for warming components of an engine include external heating devices, such as for example pumping systems, which may be fitted in parallel or series to a coolant system. Heating reservoirs, such as for example Thermo-like reservoirs, may be filled when the engine is still hot. The capacity of the reservoir is however limited and the effect produced by the heating reservoirs on the coolant or lubricant also has a limited duration.

SUMMARY

There are a number of disadvantages associated with conventional heating devices for raising the temperature of components of a combustion engine. As such it is an object of embodiments of the invention to provide a heat exchanger apparatus which is capable of providing improved heat transfer to components of a combustion engine without causing any associated pressure loss within the system. It is a further object of embodiments of the invention to provide a heat exchanger apparatus which is capable of providing improved heat transfer to components of a combustion engine prior to and after starting the engine. It is a further object of embodiments of the invention to provide a heat exchanger apparatus which is capable of affecting the temperature of both lubricant and coolant within a combustion engine.

At least some of these objects may be achieved by a heat exchanger apparatus for a combustion engine, in which the apparatus comprises:

- a heat exchange unit comprising at least one magnetic component; and
- at least one induction heater positioned adjacent to at least one magnetic component of the heat exchange unit,
- in which the induction heater is connectable to a power supply to provide inductive heating to the heat exchange unit.

The heat exchange unit may be of any suitable shape and dimension. The heat exchange unit may be a plate heat exchange unit. The term "plate heat exchange unit" is used herein to refer to a heat exchange unit comprising a plurality of plate members.

Preferably, at least one or each of the plurality of plate members are composed of magnetic material. In one embodiment, the heat exchange unit is brazed plate heat exchange unit.

Preferably, a plurality of channels extend through the heat exchange unit. Preferably, the plurality of channels extend substantially perpendicular to the plane of the plate members. At least one first channel is connectable to a first fluid medium, such as for example a coolant supply. At least one second channel is connectable to a second fluid medium, such as for example a lubricant supply, i.e. an oil supply. Preferably, the at least one first channel extends substantially parallel to and is spaced apart from the at least one second channel.

Plate members are superimposed and define between them first flow passages for first fluid medium and second flow passages for second fluid medium. First flow passages and second flow passages are arranged in an alternating manner between plate members. First flow passages are connected to the first channel and second flow passages are connected to the second channel. In use, heat is transferred from the second fluid medium flowing in the second flow passages to the first fluid medium flowing in the first flow passages through plate members. First flow passages and second flow passages may comprise turbulators to create turbulences in the flows in order to promote thermal exchanges.

In one embodiment, the induction heater is positioned adjacent to the heat exchange unit so as to substantially surround the heat exchange unit. The term "substantially surround" is used herein to refer to the induction heater surrounding substantially an entire outer perimeter surface of the heat exchange unit.

Preferably, the heat exchange unit is a coolant/oil heat exchanger and the coolant is a liquid coolant.

In one embodiment, the induction heater provides at least one opening extending into a cavity. The at least one opening and cavity are shaped and dimensioned to receive the heat exchange unit. In one embodiment, a first end of the induction heater provides a first opening, a second opposed end of the induction heater provides a second opening, and a channel (or cavity) is in communication with the first and second openings and extends therebetween. The channel or cavity defines the longitudinal axis of the induction heater.

Preferably, the induction heater is positioned adjacent to the heat exchange unit so as to substantially surround an entire outer perimeter surface of the heat exchange surface while the longitudinal axis of the induction heater extends substantially parallel to at least one of the plurality of channels provided within the heat exchange unit. Preferably, the induction heater is positioned such that the longitudinal axis of the induction heater extends substantially parallel to the at least one first channel connectable to a first fluid medium (for example a coolant supply) and/or the at least one second channel connectable to a second fluid medium (for example a lubricant supply).

In use, at least a portion of the heat exchange unit is received or positioned within the channel or cavity provided by the induction heater. In order to maximise the efficiency of the heat exchanger apparatus, substantially all of the heat exchange unit is received or positioned within the channel or cavity provided by the induction heater. The channel or cavity of the induction heater unit may be shaped and dimensioned to be in contact with the outer perimeter surface of the heat exchange unit. Alternatively, the channel or cavity of the induction heater unit may be shaped and dimensioned to be spaced apart from the outer perimeter surface of the heat exchange unit during use.

In one embodiment, the induction heater may be located between a pair of adjacent plate members of the heat exchange unit. Preferably, the induction heater is located between a pair of adjacent plate members located substantially centrally within the heat exchange unit. The induction heater may however be located between any pair of adjacent plate members located at any suitable location within the heat exchange unit.

In one embodiment, the induction heater and the heat exchange unit are provided as a single, integral unit. Alternatively, the induction heater may be mounted within or around the heat exchange unit prior to use. For example, the induction heater may be insertable, prior to use, between an adjacent pair of plate members of a heat exchange unit.

In one embodiment, the heat exchange unit may provide at least one opening extending into a cavity. The at least one opening and cavity are preferably provided between a pair of adjacent plate members. The pair of adjacent plate members preferably define a pair of opposed surfaces forming the cavity of the heat exchange unit. The at least one opening and cavity are preferably shaped and dimensioned to receive an induction heater. The induction heater may be slideable through the at least one opening to be received within the cavity of the heat exchange unit.

In one embodiment, the heat exchange unit comprises a plurality of plate members which are releasably mounted. Prior to set up, the plate members may be separated and the induction heater mounted therebetween.

The heat exchanger apparatus may further comprise at least one, preferably a plurality, of fixation members for retaining the induction heater in position relative to the heat exchange unit. The fixation members may be any suitable means, such as for example threaded screws. For example, one or more of the induction heater and the heat exchange unit, for example the plate members of the heat exchange unit, comprise at least one threaded bore shaped and dimensioned to cooperatively engage one or more threaded screws. Preferably, the induction heater and the heat exchange unit, for example the plate members, comprise at least one, preferably a plurality of, threaded bore(s) which are aligned in use to receive at least one, preferably a plurality of, threaded screw(s).

The heat exchange unit may comprise a flange located at and extending outwardly from and along the perimeter of a first end of the unit. The at least one threaded bore may be provided by the flange. The induction heater may comprise a flange located at and extending outwardly from and along the perimeter of a first end of the heater. The at least one threaded bore may be provided by the flange of the heater. The flange of the induction heater may be arranged to abut the flange of the heat exchange unit. In use, the flange of the induction heater may abut the flange of the heat exchange unit such that the threaded bore(s) of each flange are aligned to releasably engage the fixation member(s).

At least one magnetic component of the heat exchange unit, preferably each of the magnetic components, may be composed of steel. It is however to be understood that the magnetic components may be composed of any suitable magnetic material. Each magnetic component may be composed of the same magnetic material, or different magnetic material, to other components within the heat exchange unit.

The heat exchanger apparatus may further comprise a power supply in communication with the induction heater. The power supply may be selected from: an external AC power supply or a vehicle battery.

According to a second aspect one or more objects of the invention may be achieved by a vehicle comprising a combustion engine in communication with a heat exchanger apparatus as described herein. The vehicle battery is preferably connected to the heat exchanger apparatus.

According to a third aspect of the present invention one or more objects of the invention may be achieved by a method of manufacturing a heat exchanger apparatus, comprising:

positioning an induction heater adjacent to at least one magnetic component of a heat exchange unit.

The induction heater may according to one embodiment of the invention be retro-fitted to a heat exchange unit of an engine. The heat exchange unit of the engine will therefore already have been optimised for heat exchanges for that engine. The present invention therefore provides a method of providing optimised heat transfer to the heat exchange unit of the engine.

According to a fourth aspect of the present invention, one or more objects of the invention may be achieved by a method of heating a heat exchange unit comprising at least one magnetic component, comprising:

positioning an induction heater adjacent to at least one magnetic component of a heat exchange unit; and connecting the induction heater to a power supply such that the induction heater generates inductive heating to the heat exchange unit.

According to a fifth aspect of the present invention, one or more objects of the invention may be achieved by a kit for providing a heat exchanger apparatus, comprising:

a heat exchange unit comprising at least one magnetic component; and an induction heater positionable adjacent the at least one magnetic component of the heat exchange unit, in which the induction heater is connectable to a power supply to provide inductive heating to the heat exchange unit.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
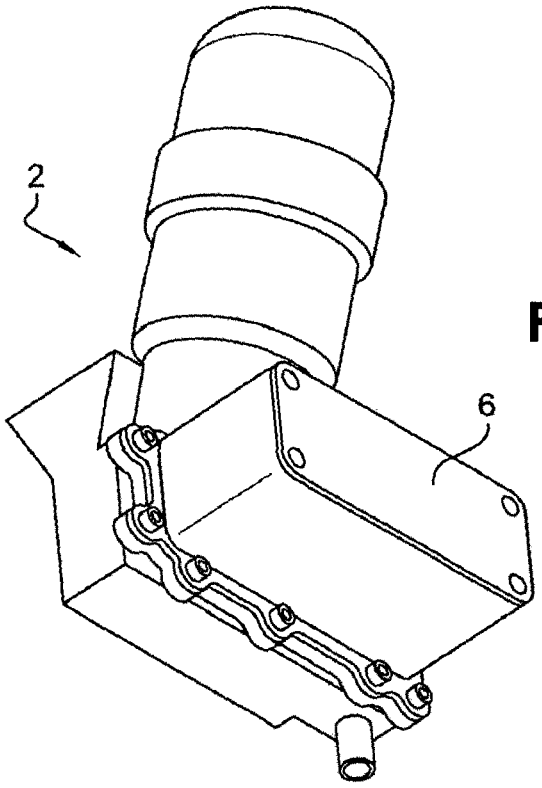
FIG. 1 is a schematic illustration of a conventional filter and heat exchanger module for a combustion engine.
Figure 2:
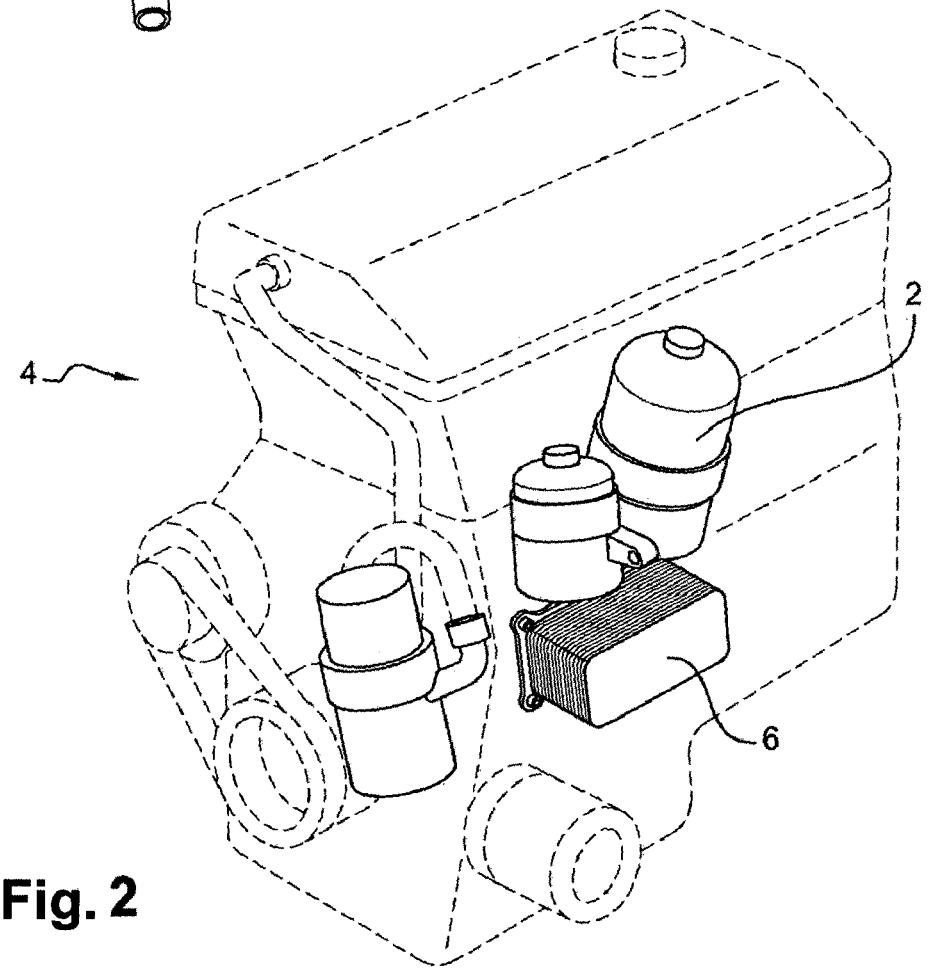
FIG. 2 is a schematic illustration of a front view of a conventional engine comprising the conventional filter and heat exchanger module of FIG. 1.
Figure 3:
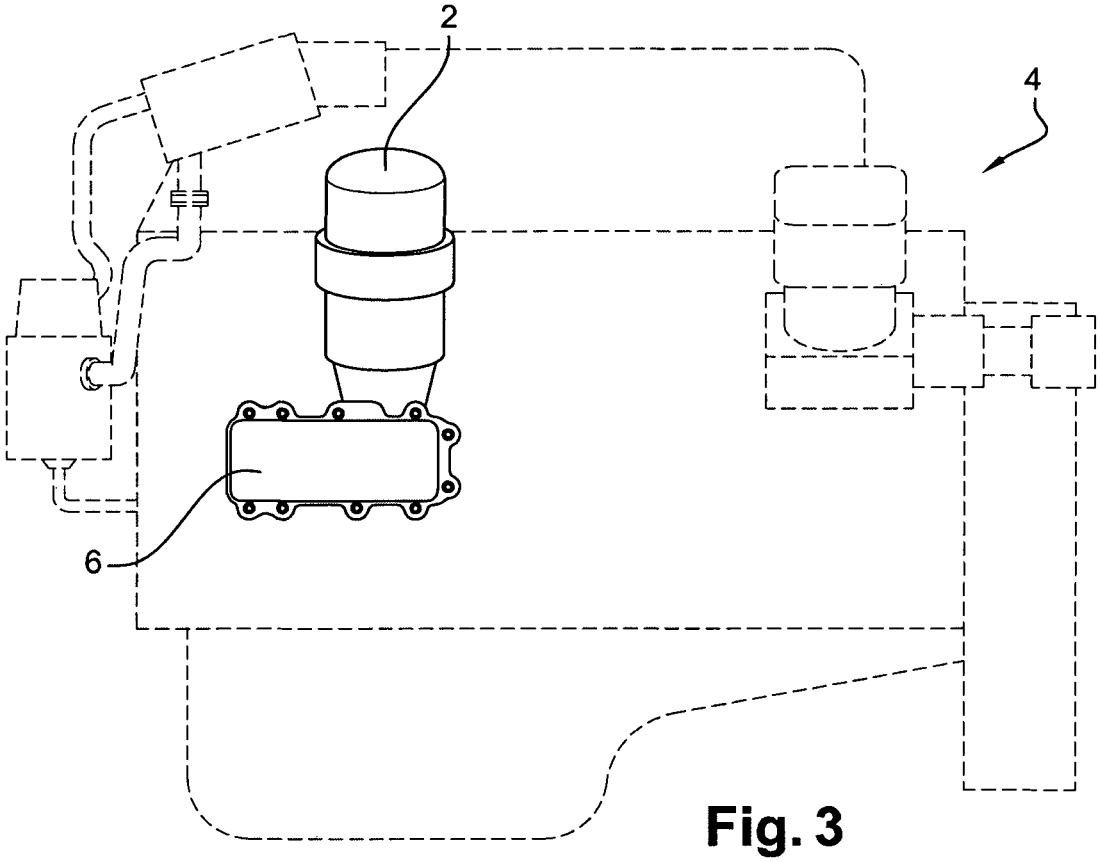
FIG. 3 is a schematic illustration of a view from side of a conventional engine comprising the conventional filter/heat exchanger module of FIG. 1.
Figure 5:
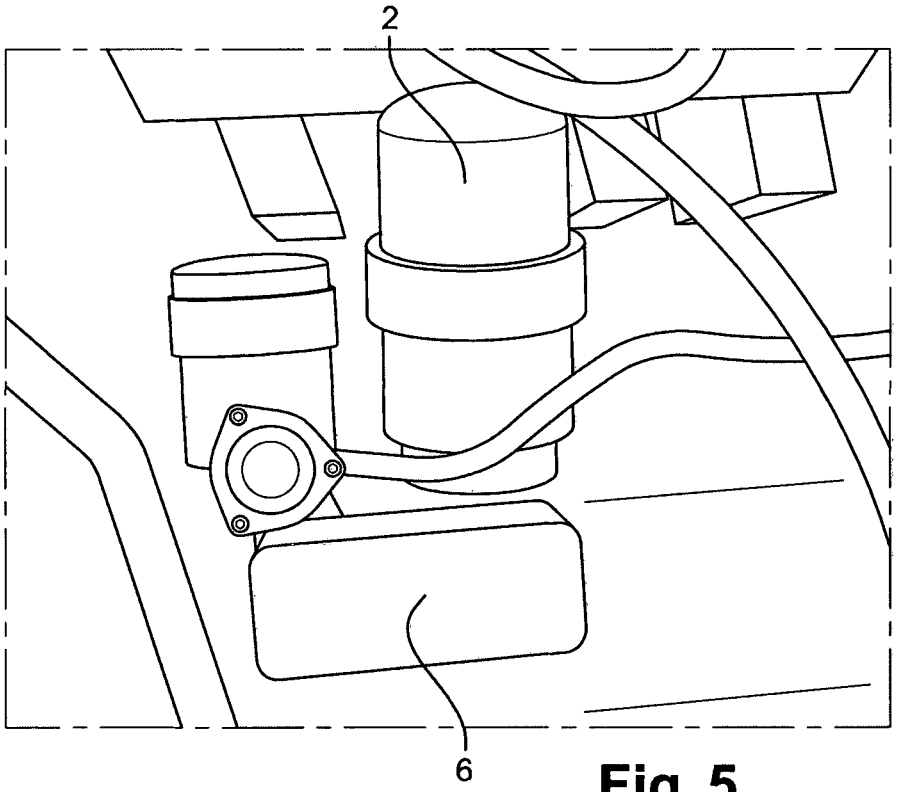
FIG. 5 is a photograph of a combustion engine comprising a conventional filter/heat exchanger module of FIG. 1.
Figure 4A:
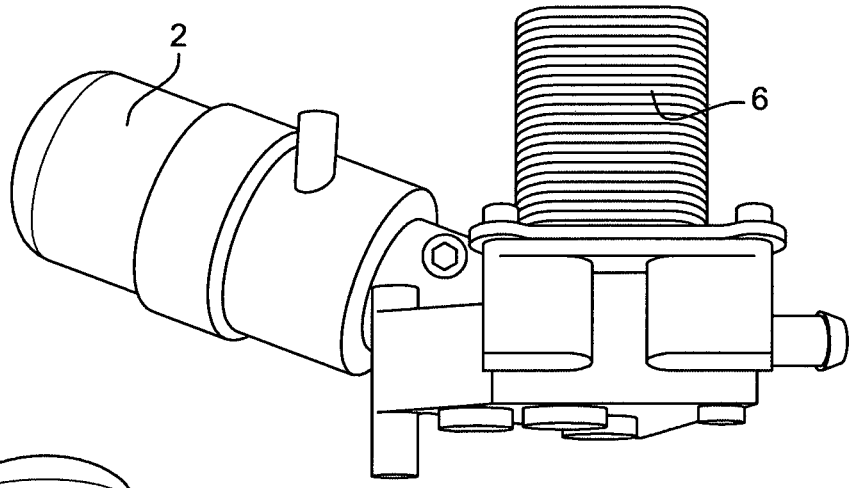
FIGS. 4A, 4B and to 4C are photographs of front and side views of the conventional filter/heat exchanger module of FIG. 1.
Figure 4B:
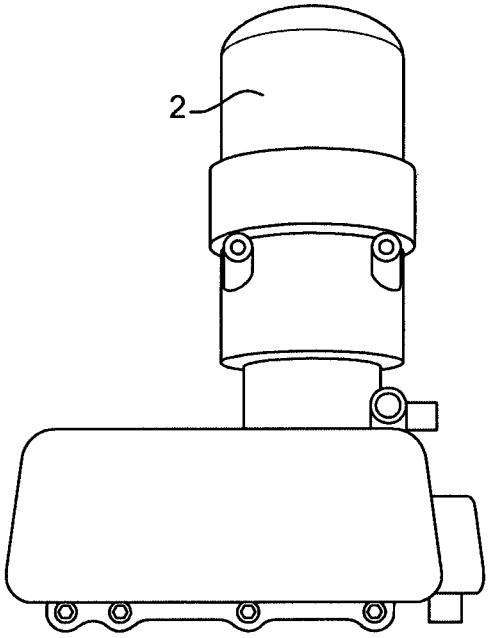
Figure 4C:
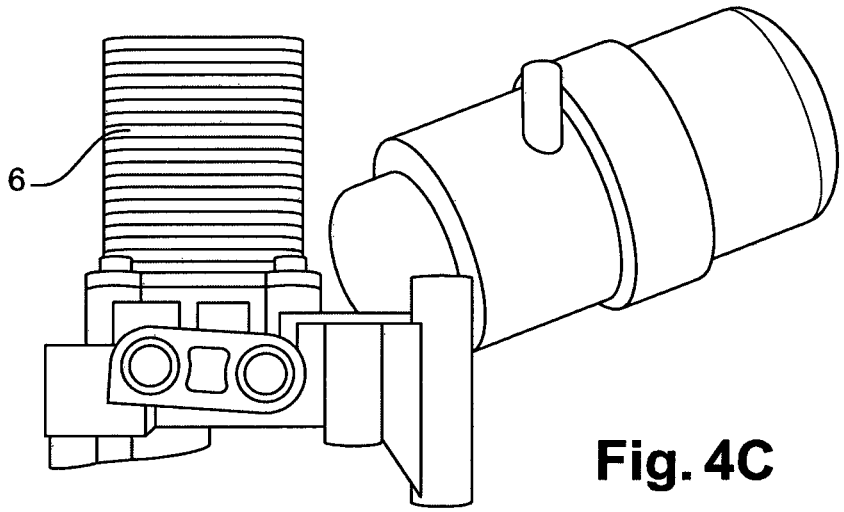

With reference to FIGS. 1 to 5, a conventional filter and heat exchanger module 2 for a combustion engine 4 comprises a heat exchange unit 6. The heat exchange unit 6 is illustrated in the Figures as having a substantially rectangular cross-section. It is however to be understood that the heat exchange unit 6 may have any suitable shape and dimensions depending on the requirements for the heat exchanger 2.

Conventional heat exchange units 6 may for example be plate heat exchange units. A plate exchange unit comprises a plurality of plate members composed of magnetic material, such as steel. The plate members are arranged in use to provide a first channel for receiving a coolant feedstream and a second channel for receiving a lubricant feedstream. The first and second channels extend substantially perpendicular to the plane of the plate members.

Plate members are superimposed, they define alternately and between them first flow passages for coolant and second flow passages for lubricant. First flow passages are connected to said first channel and second flow passages are connected to said second channel. In use, as the heated lubrication fluid feedstream (not shown) passes through the heat exchange unit 6, heat is transferred from the lubrication feedstream (not shown) to the coolant feed stream (not shown). First flow passages and second flow passages may comprise turbulators to create turbulences in the coolant and/or lubricant flows in order to promote thermal exchanges.

Figure 9:
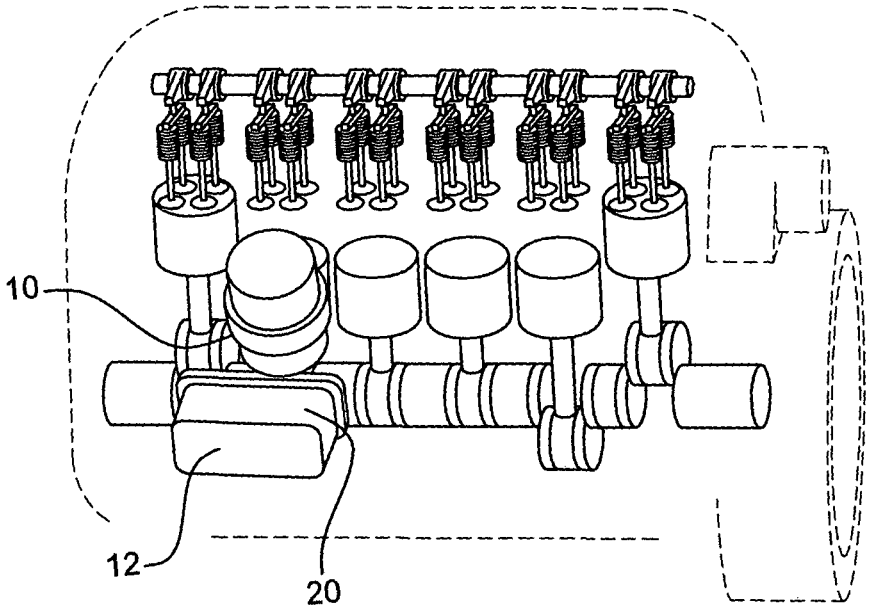
FIG. 9 is a schematic illustration of an engine lubricating system comprising a heat exchanger apparatus according to an embodiment of the present invention.
Figure 10:
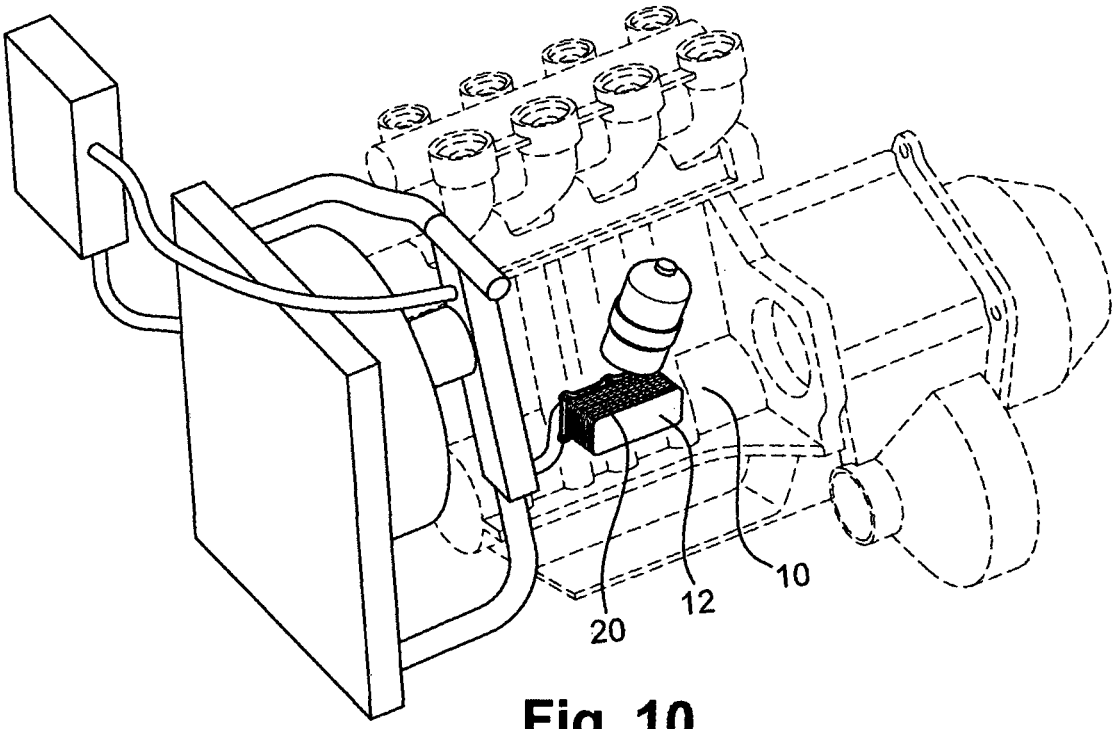
FIG. 10 is a further schematic illustration of the engine cooling system of FIG. 9.

With reference to FIGS. 6A-C, 7A-C and 8A-C, the present invention provides a heat exchanger apparatus 10 which can be retrofitted to existing heat exchange units within a combustion engine. The heat exchanger apparatus of the present invention may be installed without requiring any additional space and/or wiring within the combustion engine. The heat exchanger apparatus of the present invention may be installed without requiring any additional modification or rearrangement of the combustion engine. As shown in FIGS. 9 and 10 the heat exchanger apparatus of the present invention can be installed to existing combustion engines to warm the fluid feedstreams.

Figure 6A:
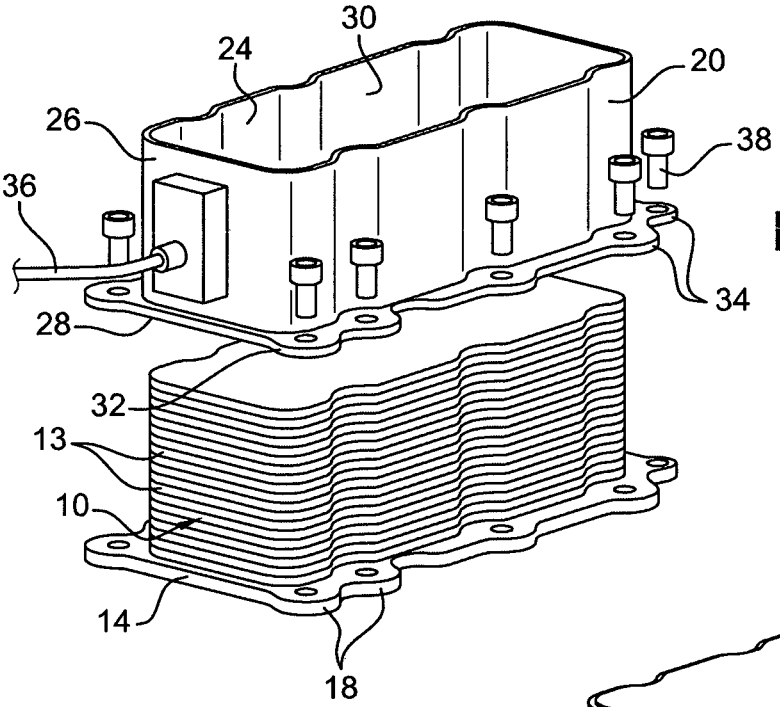
FIG. 6A is an exploded schematic view of a heat exchanger apparatus according to one embodiment of the present invention.
Figure 6B:
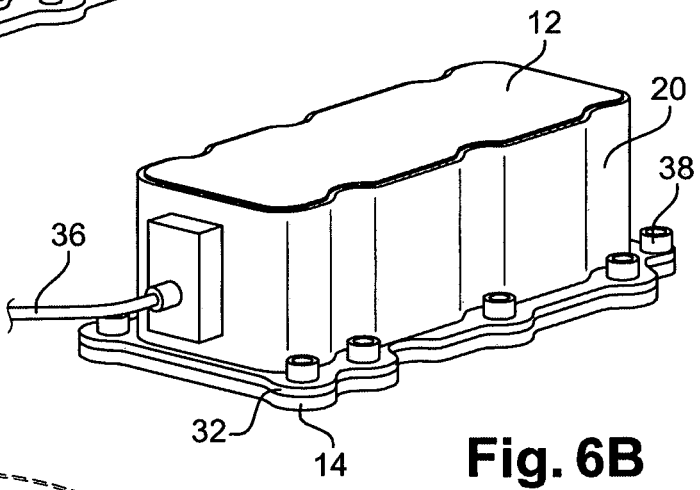
FIG. 6B is a schematic illustration of the heat exchanger apparatus of FIG. 6A.

With reference to FIGS. 6A to 6B, according to one embodiment of the present invention, the heat exchanger apparatus 10 comprises a heat exchange unit 12. The heat exchange unit 12 is illustrated in the Figures as having a substantially rectangular cross-section. It is however to be understood that the heat exchange unit 12 may have any suitable shape and dimensions depending on the requirements for the heat exchanger apparatus 10.

The heat exchange unit 12 is in this embodiment a plate exchange unit comprising a plurality of plate members 13 composed of steel. It is however to be understood that the heat exchange unit 12 may be composed of any suitable magnetic material. The plate members 13 are predominantly rectangular in shape and are stacked ontop of each other top provide the heat exchange unit 12. The heat exchange unit 12 may not be composed entirely of magnetic material however at least one component of the heat exchange unit 12 is composed of a magnetic material.

As discussed in relation to the conventional heat exchange unit 6, the heat exchange unit 12 comprises at least one first channel (not shown) in communication with a coolant feedstream of the engine and at least one second channel (not shown) in communication with a lubricant feedstream of the engine. The heat exchange unit 12 is arranged in use to transfer heat from the lubricant feedstream to the coolant feedstream as the feedstreams pass through the heat exchange unit.

The heat exchange unit 12 further comprises provides a flange 14 extending outwardly along the perimeter of the base 16 of the heat exchange unit 12. The flange 14 provides a plurality of spaced apart threaded bores 18 extending therethrough.

The heat exchanger apparatus 10 further comprises an induction heater 20.

The induction heater 20 provides a first opening 24 at the first end 26 of the heater 20, and a second opening (not shown) at the opposed base end 28 of the heater 20. The first and second openings are in communication with a cavity 30 extending therebetween. The openings 24 and the cavity 30 are shaped and dimensioned to receive the heat exchange unit 12. The cavity 30 has a predominantly rectangular cross-section. The induction heater 20 provides a cavity 30 shaped and dimensioned to receive substantially the entirety of the heat exchange unit 12. It is however to be understood that the induction heater 20 may in some embodiments only receive a portion of the heat exchange unit 12 within the cavity 30.

The induction heater 20 further comprises a flange 32 extending outwardly along the perimeter of the base end 28 of the induction heater 20. The flange 32 provides a plurality of spaced apart threaded bores 34 extending therethrough. The induction heater 20 further comprises an electrical interface 36 for connection to a power supply, ie. to the power supply of the engine, to provide inductive heating to the heat exchange unit 12.

In use, the heat exchange unit 12 is inserted through the second opening (not shown) provided at the base end 28 and received within the cavity 30 of the induction heater 20. The induction heater 20, in particular the cavity 30, is shaped and dimensioned to provide a close fit with the heat exchange unit 12. It is however to be understood that in some embodiments the induction heater 20 may be spaced apart from the heat exchange unit 12. The illustrated embodiment shows the whole of the heat exchange unit 12 as being received within the cavity 30. It is however to be understood that only a portion of the heat exchange unit 12 may be received within the induction heater 20.

The flange 14 of the heat exchange unit 12 abuts the flange 32 of the induction heater 20. The threaded bores 18 provided by flange 14 of the heat exchange unit 12 are aligned with the threaded bores 34 of the flange 32 of the induction heater 20.

Fixation members 38 are received within and cooperatively engages the threaded bores 18, 32 of the heat exchanger apparatus 10 to secure the induction heater 20 and the heat exchange unit 12 in position relative to each other. In the illustrated embodiment the fixation members 38 are threaded screws, it is however to be understood that any suitable fixation members 38 may be used in order to secure the induction heater 20 in position relative to the heat exchange unit 12 and to secure the apparatus 10 in position within the engine.

Figure 7A:
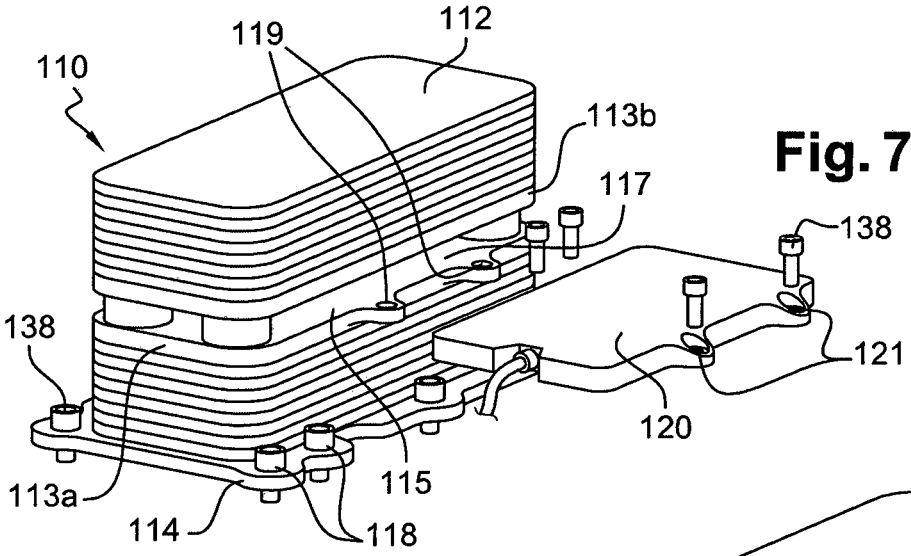
FIG. 7A is an exploded schematic view of a heat exchanger apparatus according to a further embodiment of the present invention.
Figure 7B:
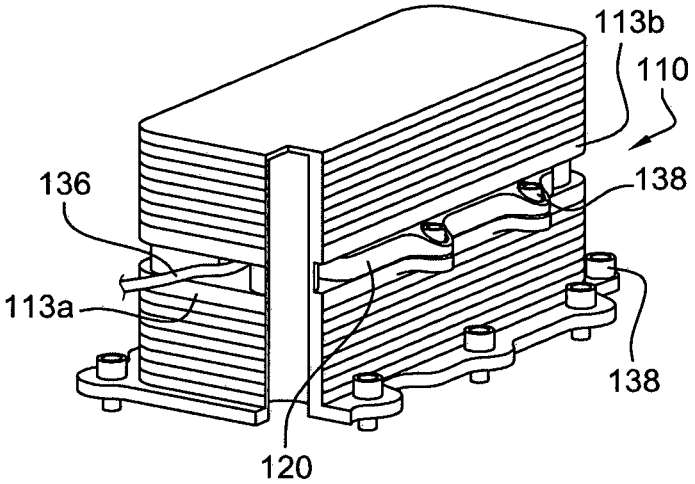
FIG. 7B is a schematic illustration of the heat exchanger apparatus of FIG. 7A.
Figure 7C:
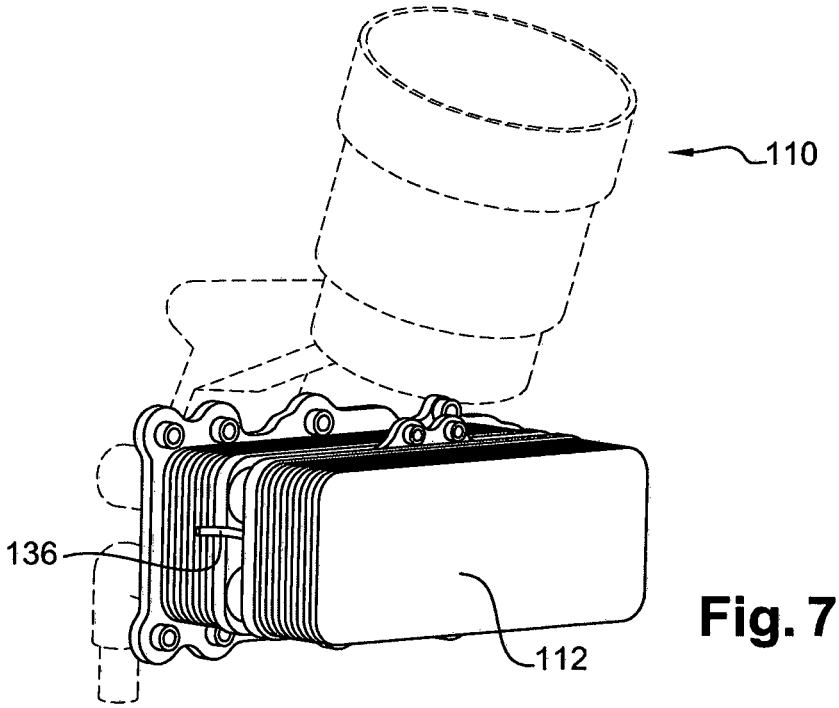
FIG. 7C is a schematic illustration of a filter and heat exchanger module comprising the heat exchanger apparatus of FIG. 7B.

With reference to FIGS. 7A-C, according to a further embodiment of the present invention, the heat exchanger apparatus 110 comprises a heat exchange unit 112. The heat exchange unit 112 is illustrated in the Figures as having a substantially rectangular cross-section. It is however to be understood that the heat exchange unit 112 may have any suitable shape and dimensions depending on the requirements for the heat exchanger apparatus 110. The heat exchange unit 112 is in this embodiment a plate exchange unit comprising a plurality of plate members 113 composed of steel. It is however to be understood that the heat exchange unit 112 may be composed of any suitable magnetic material. The plate members 113 are predominantly rectangular in shape and are stacked on top of each other to provide the heat exchange unit 112. The heat exchange unit 112 may not be composed entirely of magnetic material however at least one component of the heat exchange unit 112 is composed of a magnetic material.

Figure 6C:
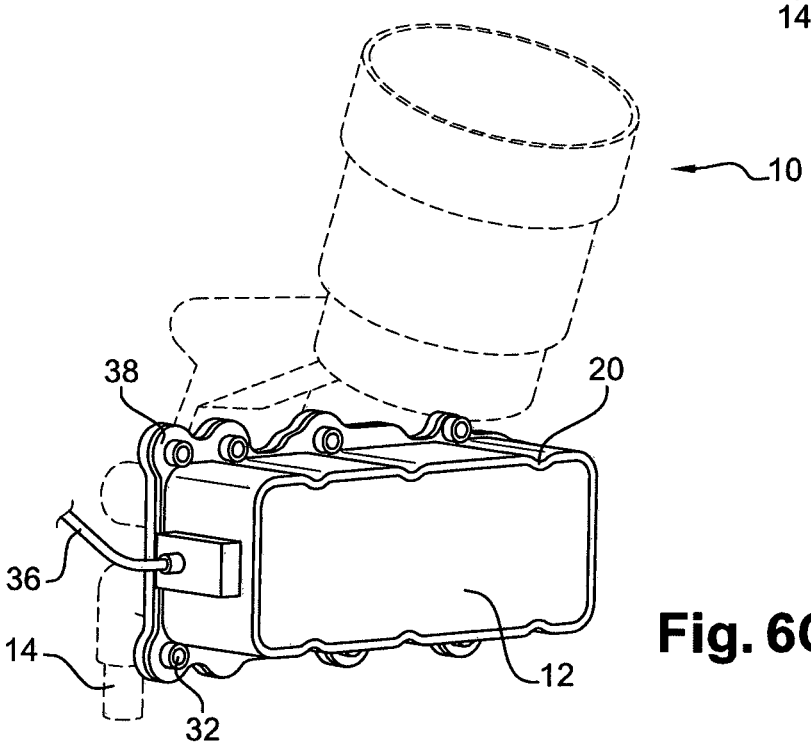
FIG. 6C is a schematic illustration of a filter and heat exchanger module comprising the heat exchanger apparatus of FIG. 6A.

As discussed in relation to FIGS. 6A-C, the heat exchange unit 112 of FIGS. 7A-C comprises at least one first channel (not shown) in communication with a coolant feedstream of the engine and at least one second channel (not shown) in communication with a lubricant feedstream of the engine. The heat exchange unit 112 is arranged in use to transfer heat from the lubricant feedstream to the coolant feedstream as the feedstreams pass through the heat exchange unit.

The heat exchange unit 112 further comprises a flange 114 extending outwardly along the perimeter of the base 116 of the heat exchange unit 112. The flange 114 provides a plurality of spaced apart threaded bores 118 extending therethrough.

The heat exchange unit 112 further comprises an opening 115 extending into a cavity 117 shaped and dimensioned to receive and induction heater 120. The cavity 117 is provided between a pair of adjacent plate members 113*a*, 113*b* located substantially centrally within the stack of plate members 113 of the heat exchange unit 112. It is however to be understood that the induction heater may however be located between any pair of adjacent plate members located at any suitable location within the heat exchange unit. The pair of adjacent plate members 113*a*, 113*b* define the lower and upper surfaces of cavity 117 respectively. The lower plate member 113*a* provides a plurality of threaded bores 119.

The heat exchanger apparatus 110 further comprises an induction heater 120. The induction heater 120. The induction heater 120 is substantially flat in cross-section. The induction heater 120 is a plate-like member.

The induction heater 120 further comprises a plurality of threaded bores 121. The induction heater 20 is shaped and dimensioned to be received within the cavity 117 of the heat exchange unit 112.

The induction heater 120 further comprises an electrical interface 136 for connection to a power supply, ie. to the power supply of the engine, to provide inductive heating to the heat exchange unit 112.

In use, the induction heater 120 is slideably received within cavity 117 of the heat exchange unit 112. The induction heater 120 is shaped and dimensioned to provide a close fit within cavity 117 of the heat exchange unit.

Fixation members 138 are received within and cooperatively engage each of the threaded bores 118 of the heat exchange unit 112 and threaded bores 121 of the induction heater 120. The fixation members 138 secure the heat exchange unit 112 in position within the engine and secure the induction heater 120 to plate member 113*a* of the heat exchange unit 112.

Figure 8A:
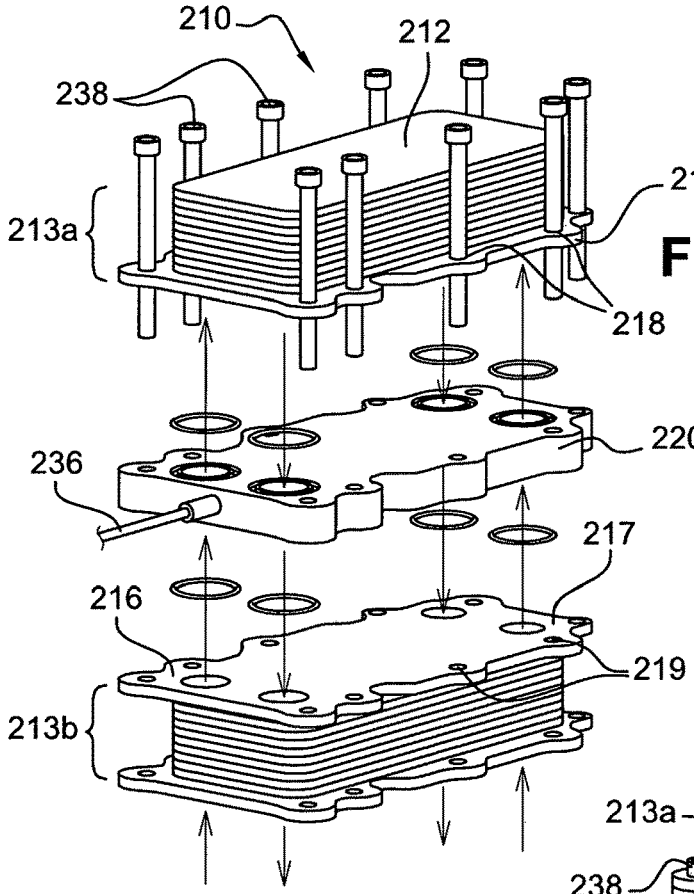
FIG. 8A is an exploded schematic view of a heat exchanger apparatus according to a further embodiment of the present invention.
Figure 8B:
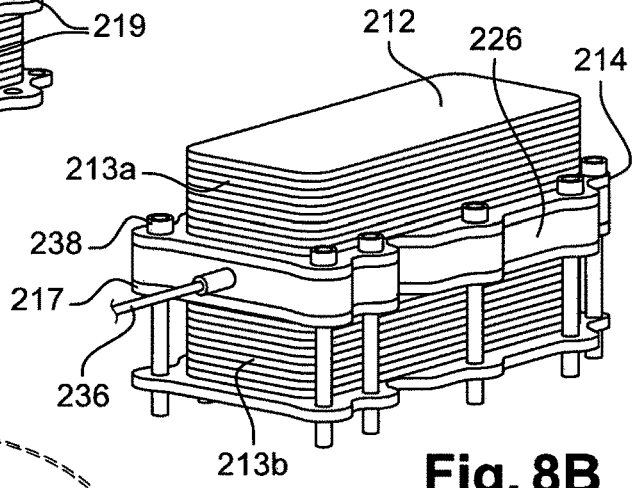
FIG. 8B is a schematic illustration of the heat exchanger apparatus of FIG. 8A.
Figure 8C:
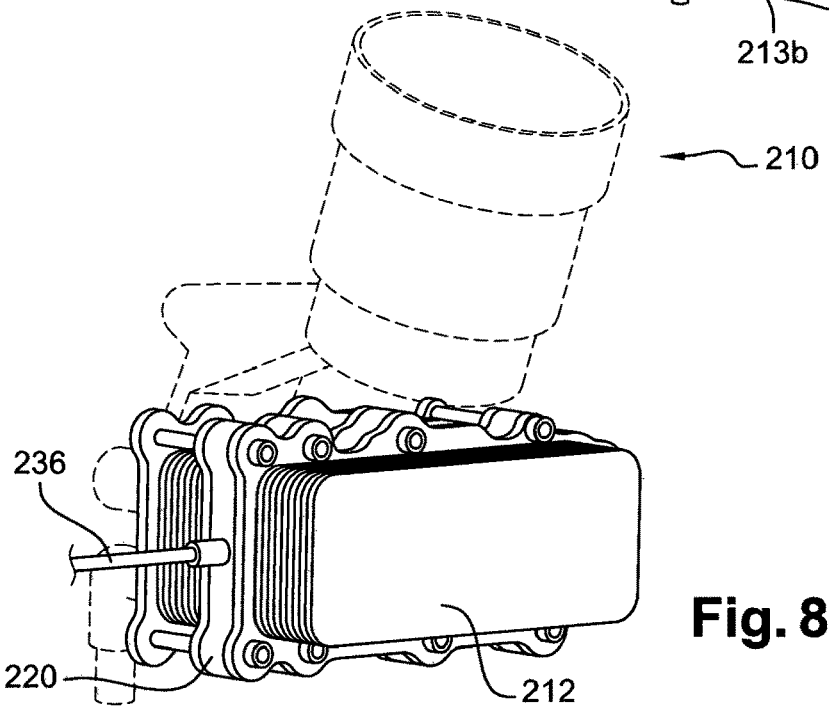
FIG. 8C is a schematic illustration of a filter and heat exchanger module comprising the heat exchanger apparatus of FIG. 8A.

With reference to FIGS. 8A-C, in a further embodiment the heat exchange unit 212 comprises a plurality of plate members 213. The plurality of plate members are separable into an upper portion of plate members 213*a* and a lower portion of plate members 213*b*. The lower surface of the upper portion of plate members 213*a* provides a flange 214 shaped and dimensioned to extend beyond the dimensions of the plate members 213. The flange 214 extends outwardly from and along the perimeter of the lower surface of the upper portion of plate members 213*a*. The flange provides a plurality of spaced apart threaded bores 218.

The upper surface 216 of the lower portion of plate members 213*b* provides a flange 217 shaped and dimensioned to extend outwardly beyond the dimensions of the plate members 213. The flange 217 extends outwardly from and along the perimeter of the upper surface of the lower portion of plate members 213*b*. The flange 217 provides a plurality of spaced apart threaded bores 219.

An induction heater 220 is shaped and dimensioned to be received between the upper and lower plate members 213*a*, 213*b*. The induction heater 220 further provides a plurality of spaced apart threaded bores located along the perimeter thereof.

The induction heater 200 is substantially plate-like in shape and further comprises an induction electrical interface 236 for connection to a power supply.

In use, the induction heater 220 is placed on top of the upper surface 216 of the lower portion 213*b* of plate members. The upper portion 213*a* of plate members is then position on top of the induction heater 220. Fixation members 238, threaded screws, are then inserted through the aligned bores of the upper portion 213*a*, induction heater 220 and lower portion 213*b* of plate members to secure the heat exchange unit 212 and induction heater 220 in position.

Once secured in position, power is supplied through the induction electrical interface 36, 136, 236 to the induction heater 20, 120, 220. The induction heater 20, 120, 200 provides inductive heating to the magnetic components of the heat exchange unit 12, 112, 212. The temperature of the heat exchange unit 12, 112, 212 therefore increases causing warming of the fluid feedstreams (coolant and lubricant) which are flowing therethrough. As the lubricant feedstream warms, the viscosity decreases, making engine start up easier. The lubricant is able to be maintained at a warmer temperature for longer due to the simultaneous heating of the coolant feedstream within the heat exchange unit.

The heat exchanger apparatus of embodiments of the present invention may be assembled without causing any disturbance to the fluid feedstreams of the engine. The heat exchanger apparatus of the present invention, in particular the induction heater, is not in direct contact with any fluids, for example coolant or lubricant, within the engine. Therefore, the heat exchanger apparatus of embodiments of the present invention may be used without any risk of pressure loss within the engine thereby providing heating to the fluids to ensure the engine runs more efficiently compared to conventional engine fluid heating devices.

The heat exchanger apparatus according to embodiments of present invention is dimensioned to be received within the space provided by combustion engines without requiring any additional space and/or rearrangement of components within the engine. The heat exchanger apparatus may be retrofitted to existing components of an engine. Embodiments of the present invention provides a more efficient and compact system for heating an engine of a motor vehicle as the present invention provides an induction heater mounted directly on components of the engine of the motor vehicle. Embodiments of the invention may be provided as a single, integral component for insertion into an engine.

The induction heater is positioned adjacent the heat exchange unit of the apparatus to provide a larger heat exchange surface compared to conventional engine fluid heaters. Embodiments of the present invention therefore provide a heat exchanger apparatus with improved power capacity and/or inductive heat transfer capacity compared to conventional engine fluid heater. Embodiments of the present invention also provides a heat exchanger apparatus with reduced or substantially no risk of coolant boiling and/or lubricant (e.g. oil) cocking.

Embodiments of the present invention provides a heat exchanger apparatus which provides improved and more efficient heating of engine fluids by warming both the coolant and the lubricant. There is therefore a reduced risk, or no risk, that the heated lubricant will be quickly cooled by the coolant. Embodiments of the present invention therefore provides more efficient heating of the lubricant. As the temperature of the lubricant increases, the lubricant becomes less viscous. This reduction in viscosity of the lubricant makes it easier to start the engine. Embodiments of the present invention therefore provide a heat exchanger apparatus which improves the startability of the engine over a longer time period by ensuring that the lubricant is maintained at a higher temperature for a longer duration.

It is to be understood that the present invention is not limited to the embodiments described above and illustrated in the drawings; rather, the skilled person will recognize that many changes and modifications may be made within the scope of the appended claims.

The invention claimed is:

1. A heat exchanger apparatus for a combustion engine, in which the heat exchanger apparatus comprises: a heat exchange unit, being a coolant/oil heat exchanger, mounted on a side of a cylinder block of the combustion engine and comprising at least one magnetic component; and at least one induction heater positioned adjacent to at least one magnetic component of the heat exchanger, in which the induction heater is connectable to a power supply to provide inductive heating to the heat exchanger, the heat exchange unit comprises a plurality of plate members composed of magnetic material, and in which the induction heater is located between a pair of adjacent plate members of the heat exchange unit.

2. A heat exchanger apparatus as claimed in claim 1, in which the coolant is a liquid coolant.

3. A heat exchanger apparatus as claimed in claim 1, in which said at least one magnetic component is composed of steel.

4. A heat exchanger apparatus as claimed in claim 1, further comprising a power supply in communication with the induction heater.

5. A heat exchanger apparatus as claimed in claim 4, in which the power supply is selected from: an external AC power supply or a vehicle battery.

6. A vehicle comprising a combustion engine in communication with a heat exchanger apparatus as claimed in claim 1.

7. A method of manufacturing a heat exchanger apparatus, comprising: providing a heat exchange unit, being a coolant/oil heat exchanger, and comprising at least one magnetic component; positioning at least one induction heater adjacent to at least one magnetic component and between a pair of adjacent plate members of the heat exchanger; connecting the induction heater to a power supply to provide inductive heating to the heat exchanger; and mounting the heat exchange unit on a side of a cylinder block of the combustion engine.

8. A heat exchanger apparatus as claimed in claim 1, the heat exchange unit further comprising a cavity configured to receive the induction heater, wherein the induction heater is a plate-like member.

* * * * *